United States Patent [19]

Baratelli et al.

[11] 4,267,923

[45] May 19, 1981

[54] EYEGLASS CASE

[75] Inventors: Charles A. Baratelli; Aletha V. Baratelli, both of Ft. Lauderdale, Fla.

[73] Assignee: Itek Corporation, Lexington, Mass.

[21] Appl. No.: 55,666

[22] Filed: Jul. 9, 1979

[51] Int. Cl.[3] ..... A45C 11/04

[52] U.S. Cl. ..... 206/5; 229/56; 229/72

[58] Field of Search ..... 206/5, 6; 229/56, 72

[56] References Cited

U.S. PATENT DOCUMENTS

| | | | |
|---|---|---|---|
| 1,303,485 | 5/1919 | Lindeman | 206/6 |
| 1,633,417 | 6/1927 | Perry | 206/6 |
| 1,638,727 | 8/1927 | Dadourian | 206/5 |
| 1,842,599 | 1/1932 | Fraser | 206/5 |
| 2,187,177 | 1/1940 | Schutz | 206/6 |
| 2,370,967 | 3/1945 | Junkin | 206/6 |
| 2,473,292 | 6/1949 | Nathan | 206/5 |
| 2,650,701 | 9/1953 | Parsell | 206/5 |
| 2,657,791 | 11/1953 | Grosvenor | 206/6 |
| 3,921,797 | 11/1975 | Platt | 206/5 |

*Primary Examiner*—Joseph Man-Fu Moy

*Attorney, Agent, or Firm*—Homer O. Blair; Robert L. Nathans; Gerald H. Glanzman

[57] ABSTRACT

An eyeglass case having a novel separator element incorporated within it to prevent the temple tips of an inserted pair of eyeglasses from contacting and rubbing against the lenses thereof. The separator element preferably comprises a flexible strip secured to an inside edge of the case and extending into the case a distance of approximately one-third the width of the case such that when a pair of eyeglasses are inserted into the case, the temple portions of the eyeglasses will be positioned on one side of the separator element while the lenses thereof will be positioned on the opposite side thereof.

The invention is primarily designed for use in connection with cases of the "open-end" type although it is not restricted thereto.

9 Claims, 3 Drawing Figures

EYEGLASS CASE

DESCRIPTION

1. Technical Field

The present invention relates generally to the field of eyeglass cases. More particularly, the invention relates to an eyeglass case having a novel separator element incorporated within it to prevent the temple tips of an inserted pair of eyeglasses from contacting and rubbing against the lenses thereof.

2. Background Art

One of the problems that has been encountered in the design of eyeglass cases concerns the fact that in many frame styles, especially in today's styles employing large lens sizes, the tips of the temple portions of the eyeglass frames tend to contact and rub against the back surface of the lenses when the glasses are in a folded-up position. This contact can occur not only when the glasses are being inserted into and removed from a case, but also when they are simply being stored within the case, and can severely scratch or otherwise damage the surface of the lenses.

This problem is compounded by the fact that polymer lenses and tinted lenses are becoming increasingly popular, and these lenses are significantly more vulnerable to being scratched or abraded than the more conventional glass lenses.

The existence of this problem has been recognized in the past and efforts have been made to solve it. See, for example, U.S. Pat. Nos. 1,638,727 to Dadourian, 2,650,701 to Parsell and 2,657,791 to Grosvenor. These patents describe eyeglass cases of the fold-over type having appropriate means to protect the lenses of an inserted pair of eyeglasses when the case is closed. The disclosed designs are primarily designed for use in connection with hard cases, however, and, more importantly, are not suitable for use with the "open-end" type of case which is one of the most popular styles because of its convenience and low cost.

Thus, there is a need for an eyeglass case employing means to effectively protect lenses of a pair of eyeglasses from being scratched or otherwise damaged by the temple portions and which is capable of being incorporated into an open-end case, and, further, which will not significantly add to the cost of manufacturing the case.

DISCLOSURE OF THE INVENTION

In accordance with the present invention, a novel eyeglass case is provided which incorporates appropriate structure to prevent the temple tips of a pair of eyeglasses from abrading or otherwise damaging the inside surface of the lenses when the eyeglasses are inserted into, removed from or stored in the case.

In accordance with a presently most preferred embodiment of the invention, this structure takes the form of a separator element positioned within the case in such a way as to positively prevent the temple tips from contacting the lenses while, at the same time, not interfering with the insertion and removal of the eyeglasses from the case in any way. The separator element preferably consists of a strip of flexible material, for example, flexible vinyl or the like, secured to an inside edge of the case and extending from adjacent one end of the case to adjacent the opposite end of the case and outwardly into the case a distance of approximately one-third the width of the case.

When a pair of eyeglasses are inserted into a case designed in accordance with the present invention, the temple portions of the frames will slide along one side of the separator element while the lenses will be on the opposite side of the separator element, and, in this way, the lenses and temples will always be separated from one another and prevented from coming into contact.

The present invention is very simple in design and its implementation does not appreciably add to the cost of the case. Yet, it is highly effective in protecting a pair of eyeglasses and, in particular, the lenses of a pair of eyeglasses without making it more difficult to insert or remove the eyeglasses from the case.

Although the invention has been designed primarily for use in connection with open-end cases, it is not limited to such styles but can be incorporated into many types of cases as will become apparent hereinafter.

Further advantages and features of the invention will also become apparent hereinafter in connection with the description of the best mode for carrying out the invention.

BEST MODE FOR CARRYING OUT THE INVENTION

Figure 1:
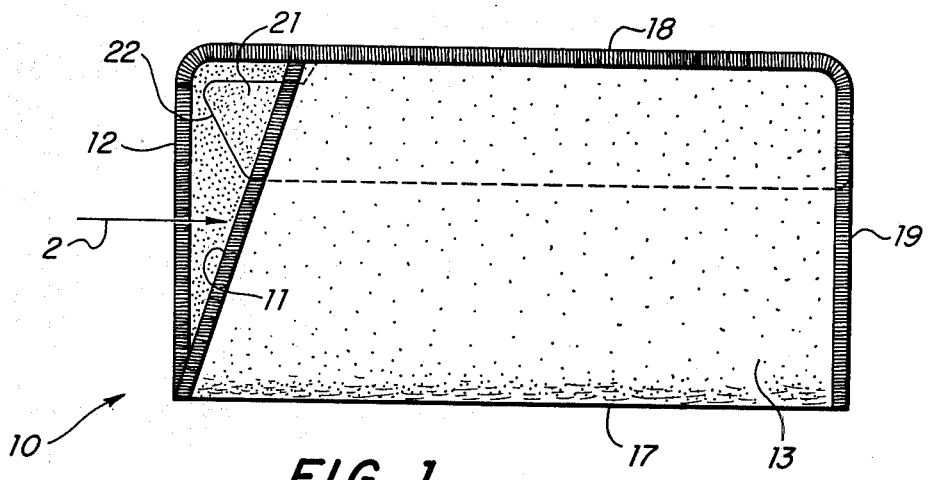
FIG. 1 illustrates an eyeglass case according to a presently most preferred embodiment of the invention.
Figure 2:
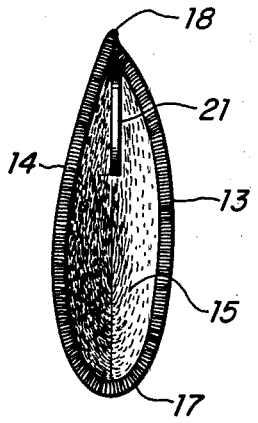
FIG. 2 illustrates an end view of the eyeglass case of FIG. 1 looking in the direction of arrow 2 in FIG. 1.
Figure 3:
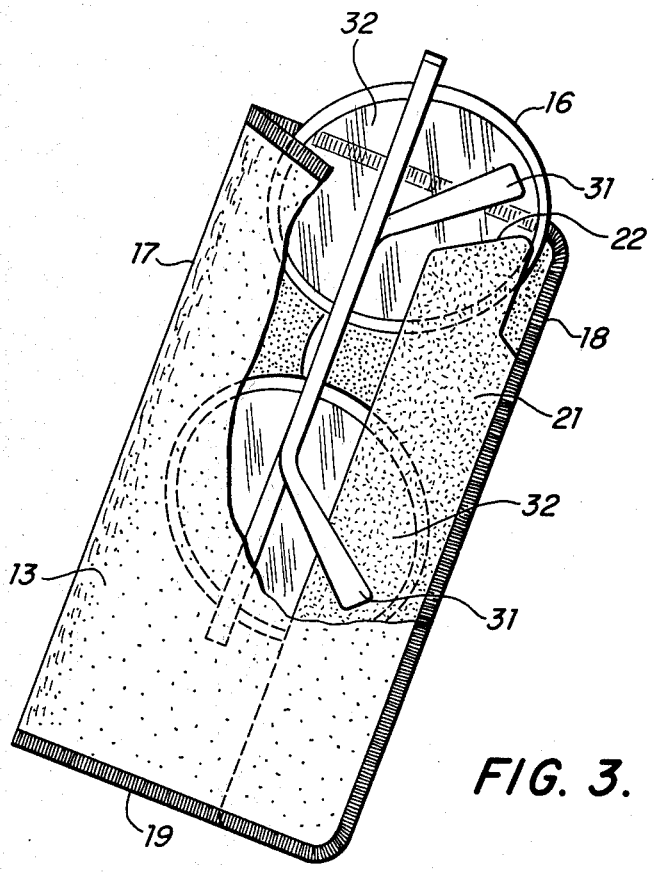
FIG. 3 illustrates the eyeglass case of FIG. 1 with a portion of a side wall removed to facilitate explanation and also with a pair of eyeglasses partially inserted into the case.

FIGS. 1 through 3 illustrate an eyeglass case in accordance with a presently most preferred embodiment of the invention. The case is generally identified by reference number 10 and the case illustrated is of a style that is usually referred to as an "open-end" case in that a pair of eyeglasses are inserted into and removed from the case through an opening 11 in an end 12. It should be clearly understood that the present invention is not to be limited to any particular case style, however. The invention could, for example, also be employed in cases in which the eyeglasses are inserted through an opening in a side edge of the case or in a wall thereof as well as in cases employing a flap or some other type of closure element to close the case.

The case 10 comprises a pair of side walls 13 and 14 which define a cavity or pocket 15 therebetween for receipt of a pair of eyeglasses 16 as shown in FIG. 3. The case can be constructed in any convenient manner. In the illustrated embodiment, edge 17 is simply formed by folding the material making up the case, while edge 18 and end 19 are closed by being stitched. The closed edges and ends can also be formed by heat sealing or by any other method of mechanical joining that is desired.

The case can be constructed of any one of many materials normally used in cases such as plastics, leather, cloth or the like. It can be a hard rigid case or a soft flexible case, or a soft case having a rigid liner. In general, the invention is simply not restricted to any particular case but can be used in many, if not most, of the styles and types of cases that are available.

Reference number 21 identifies the separator element to which the present invention is primarily directed.

This element consists of a flat strip of material that is positioned within and attached to the case along side edge 18. It extends from near the open end 12 to or adjacent to the closed end 19 as shown.

Element 21 is joined to edge 18 in such a way that it is somewhat free to pivot (in and out of the paper in FIG. 1) around the line by which it is attached to the edge. Also, it is joined in such a way that it will automatically assume a generally centered position within the case pocket as illustrated in FIG. 2 and not lie against either of the side walls 13 or 14. This is important to assure easy insertion of the eyeglasses into the case as will be explained hereinafter and can be accomplished readily by stitching, heat sealing or otherwise attaching element 21 to edge 18. Element 21 could also be integral with walls 13 and 14 and formed simply by folding it over before stitching or heat sealing.

Separator element 21 extends into the case pocket for a distance that is far enough to ensure that the temple portions of an inserted pair of eyeglasses will be separated from the lens portions thereof, but not so far that it will block insertion of the eyeglasses. Generally, it has been found that it should extend approximately one-third the width of the case into the case.

Separator 21 is preferably provided with an angled edge or leader 22 (FIG. 1) to assist in properly inserting eyeglasses into the case although this is not essential.

Separator element 21 consists of a relatively rigid but flexible and non-abrasive material such as flexible vinyl, leather or the like. It is important that it be flexible so that it can bend somewhat to conform to the myriad of different eyeglass styles and sizes that are on the market. Its surface may be covered with flocking or some other soft material to help protect and cushion the lenses when the glasses are inside the case.

FIG. 3 illustrates the case with a portion of side wall 13 removed for purposes of clarity and with a pair of eyeglasses 16 partially inserted into the case. As can be seen, when the eyeglasses are inserted, the temple portions 31 thereof will be positioned on one side of the separator element 21 while the lenses 32 will be located on the opposite side. The separator element will thus positively prevent the temple ends from contacting the back surface of the lenses and thus the lenses will be fully protected from scratching or being abraded while in the case. The angled edge 22 helps to facilitate the proper insertion of the eyeglasses into the case, although, in practice, this can be accomplished very easily and, in fact, occurs almost automatically due to the fact that the separator element is centered in the case.

It is not necessary that the separator extend all the way from one end of the case to the opposite end as it could be somewhat shorter than the case itself, the only requirement, of course, being that it be of sufficient length to separate the lenses from the temple ends.

While what has been shown constitutes a presently most preferred embodiment of the invention, it should be understood that the invention may take many other forms and that the invention should accordingly be limited only insofar as necessitated by the scope of the following claims.

We claim:

1. In an eyeglass case for holding a pair of eyeglasses, said eyeglass case having a pair of elongated opposed wall portions defining a pocket therebetween for the receipt of said eyeglasses, said opposed wall portions being joined together along at least one of their respective edges to define a first longitudinal edge of said case, said wall portions further defining first and second opposite ends of said case, said first end including means defining an opening through which a pair of eyeglasses are inserted into and removed from said pocket, the improvement comprising separator means positioned within said pocket for maintaining the temple portions of said pair of eyeglasses separated from the lens portions thereof when said pair of eyeglasses are positioned within said pocket, said separator means comprising an elongated member extending partially into said pocket from said first longitudinal edge of said case and positioned generally centrally between said opposed wall portions, whereby upon insertion of a pair of eyeglasses into said pocket through said opening, the temple portions thereof will be positioned on the opposite side of said member from said lens portions thereof.

2. An eyeglass case as recited in claim 1 wherein said member comprises an angled leading edge adjacent said opening to facilitate proper insertion of said eyeglasses into said pocket.

3. An eyeglass case as recited in claim 1 wherein said member extends into said pocket from said first longitudinal edge of said case a distance of approximately one-third of the width of the case.

4. An eyeglass case as recited in claim 1 wherein said member comprises a relatively flat flexible strip.

5. Apparatus as recited in claim 4 wherein said flat flexible strip comprises a flexible vinyl strip.

6. Apparatus as recited in claim 4 and further including cushioning means provided on the surface of said strip.

7. In an eyeglass case for holding a pair of eyeglasses, said eyeglass case having a pair of elongated opposed wall portions, said opposed wall portions being joined together along their respective longitudinal edges and one end to define a pocket therebetween for receipt of said eyeglasses, the second end of said wall portions defining an opening for the insertion and removal of a pair of eyeglasses from said pocket, the improvement comprising separator means positioned within said pocket for maintaining the temple portions of said pair of eyeglasses separated from the lens portions thereof when said pair of eyeglasses are positioned within said pocket, said separator means comprising an elongated member coupled to and extending from a longitudinal edge of said case into said pocket and positioned generally centrally between said opposed wall portions.

8. An eyeglass case as recited in claim 7 wherein said member extends into said pocket from said longitudinal edge of said case a distance of approximately one-third of the width of the case.

9. An eyeglass case as recited in claim 7 wherein said member comprises a relatively flat flexible strip.

* * * * *